US006380138B1

(12) United States Patent
Ischy et al.

(10) Patent No.: US 6,380,138 B1
(45) Date of Patent: Apr. 30, 2002

(54) INJECTION MOLDED DEGRADABLE CASING PERFORATION BALL SEALERS FLUID LOSS ADDITIVE AND METHOD OF USE

(75) Inventors: Noel David Ischy, Tyler; Craig Steven Fox, Rockwall; A. Richard Sinclair, Katy, all of TX (US)

(73) Assignee: Fairmount Minerals Ltd., Chardon, OH (US)

( * ) Notice: Subject to any disclaimer, the term of this patent is extended or adjusted under 35 U.S.C. 154(b) by 0 days.

(21) Appl. No.: 09/444,901

(22) Filed: Nov. 22, 1999

Related U.S. Application Data

(63) Continuation-in-part of application No. 09/055,549, filed on Apr. 6, 1999, now Pat. No. 5,990,051.

(51) Int. Cl.[7] ..... E21B 33/13

(52) U.S. Cl. ..... 507/204; 507/219; 507/239; 166/294

(58) Field of Search ..... 507/204, 219, 507/239; 166/294

(56) References Cited

U.S. PATENT DOCUMENTS

| | | | | |
|---|---|---|---|---|
| 3,319,716 | A | 5/1967 | Dill | 166/42 |
| 3,971,852 | A | 7/1976 | Brenner et al. | 426/103 |
| 4,064,055 | A | 12/1977 | Carney | |
| 4,387,769 | A | 6/1983 | Erbstoesser et al. | 166/295 |
| 4,526,695 | A | 7/1985 | Erbstoesser et al. | 252/8.55 R |
| 4,716,964 | A | 1/1988 | Erbstoesser et al. | 166/284 |
| 5,032,297 | A | 7/1991 | Williamson et al. | |
| 5,246,602 | A | 9/1993 | Forrest | |
| 5,253,709 | A | 10/1993 | Kendrick et al. | 166/284 |
| 5,301,751 | A | 4/1994 | Githens et al. | |
| 5,354,786 | A | 10/1994 | Lau | |
| 5,356,149 | A | 10/1994 | Kane | 273/218 |
| 5,415,228 | A | 5/1995 | Price et al. | |
| 5,439,057 | A | 8/1995 | Weaver et al. | |

*Primary Examiner*—Shean C. Wu
(74) *Attorney, Agent, or Firm*—C. W. Alworth

(57) ABSTRACT

A degradable compound, which may be used as a ball sealer and as an fluid loss additive for use in the oil and gas industry is disclosed. The compound comprises a particular composition of matter and injection molding technique that provides a ball sealer which will dissolve in stimulation or wellbore fluids after stimulation operations are complete. In a similar manner the compound may be used as a fluid loss additive which enhances the fracture filter cake and will dissolve completely after use in fracturing operations. Used as a ball sealer, the surface of the ball sealer softens slightly assuring a solid seal between the ball and the casing perforation. The pure composition when dissolved into wellbore fluids does not pose a hazard and has excellent dispersion in aqueous based wellbore fluids. The same composition, may be combined with fiber-glass to manufacture a high temperature ball sealer.

10 Claims, 14 Drawing Sheets

BIOBALLS - TEST INFORMATION

AVERAGE BALL: DIAMETER 0.91 INCH / SPECIFIC GRAVITY 1.2

** DISSOLUTION TEST **

THESE RESULTS WERE COMPILED ON 4 BALLS PLACED IN STATIC FLUIDS @ SPECIFIC TEMPERATURES FOR EXTENDED PERIODS AND DIAMETERS WERE MEASURED WITH A CALIPER.

BALL DIAMETER IN INCHES

| TIME | #1 H2O @ 72F | #2 H2O @ 120F | #3 15% HCL @ 72F | #4 15% HCL @ 120F |
|---|---|---|---|---|
| HOURS | | | | |
| 0 | 0.92 | 0.90 | 0.92 | 0.88 |
| 1 | 0.91 | 0.76 | 0.88 | 0.71 |
| 2 | 0.81 | 0.62 | 0.83 | 0.62 |
| 3 | 0.79 | 0.60 | 0.82 | 0.51 |
| 4 | 0.76 | 0.53 | 0.79 | 0.44 |
| 5 | 0.76 | 0.47 | 0.74 | 0.39 |
| 8 | 0.75 | 0.39 | 0.69 | 0.21 |
| 24 | 0.51 | 0.17 | 0.49 | 0.00 |
| 48 | 0.33 | 0.06 | 0.22 | 0.00 |

FIGURE 5

** PRESSURE TEST **

THESE RESULTS WERE COMPILED ON BALLS BEING MECHANICALLY TESTED TO 7000-8000 PSI AGAINST A 3/8" HOLE. IMMEDIATELY AFTER HEATING THE BALL TO A SPECIFIC TEMPERATURE IN H2O. FAILURE CONSTITUTES EXTRUDING OVER 3/8" OF BALL MATERIAL THROUGH THE 3/8" HOLE.

BALL SEALER TEST

| BALL # | TEMPERATURE ( DEGREES F ) | TEST TIME ( HRS ) | RESULT |
|---|---|---|---|
| 1 | 140 | 0.50 | HELD PRESSURE & SHAPE |
| 2 | 130 | 0.25 | HELD PRESSURE & SHAPE |
| 3 | 120 | 1.20 | HELD PRESSURE & SHAPE |
| 4 | 130 | 0.25 | HELD PRESSURE & SHAPE |
| 5 | 140 | 1.75 | HELD PRESSURE & EXTRUDED 5/16" INTO HOLE |
| 6 | 140 | 3.10 | HAILED TO HOLD PRESSURE & EXTRUDED THROUGH HOLE |
| 7 | 130 | 1.80 | HELD PRESSURE & SHAPE |
| 8 | 110 | 3.00 | HELD PRESSURE & SHAPE |
| 9 | 100 | 3.70 | HELD PRESSURE & SHAPE |

FIGURE 6

| | OPTIMUM RANGE | POSSIBLE RANGE |
|---|---|---|
| GLYCERIN | 0.2% - 8.0% | 0.1% - 31.7% |
| WINTERGREEN OIL | 0.1% - 10.0% | 0.1% - 26.4% |
| ZOLDINE | 0.1% - 9.1% | 0.1% - 19.1% |
| PROTEIN | 12.9% - 64.3% | 1.9% - 92.8% |
| OIL | 1.1% - 24.4% | 0.1% - 31.2% |
| WATER | 16.0% - 82.0% | 5.3% - 96.2% |

| MIXING TEMPERATURE | OPTIMUM RANGE | POSSIBLE RANGE |
|---|---|---|
| | 83 F - 173 F | 56 F - 214 F |

| MOLDING TEMPERATURE | OPTIMUM RANGE | POSSIBLE RANGE |
|---|---|---|
| | 83 F - 184 F | 67 F - 214 F |

FIGURE 7

| STATE | READING NO. | STARCH (%) | INSTANT INVENTION (%) |
|---|---|---|---|
| AFTER FILTRATE & 2CC/MIN FOR 15 MINS (8PV) | 1 | 7.7 | 3.8 |
| AFTER FILTRATE & 2CC/MIN FOR TOTAL 30 MINS (16PV) | 2 | 16.4 | 15.0 |
| AFTER FILTRATE & 2CC/MIN FOR TOTAL 60 MINS (32PV) | 3 | 18.0 | 24.8 |
| AFTER FILTRATE & 2CC/MIN FOR TOTAL 6 HOURS (195PV) | 4 | 18.0 | 27.4 |
| AFTER PREVIOUS + 10LB/TG BREAKER SOL$^{n}$ AT 2CC/MIN FOR TOTAL 30 MINS (INJECTING DIRECTION) | 5 | 18.4 | 27.5 |
| + BREAKER FOR FURTHER 30 MINS (TOTAL 60 MINUTES) | 6 | 19.5 | 31.4 |
| + BREAKER FOR FURTHER 60 MINS (TOTAL 120 MINUTES) | 7 | 57.5 | 74.6 |
| FINAL VALUES IN REVERSE FLOW (CLEAN-UP) DIRECTION TO 2% KCI | 8 | 61.5 | 80.7 |

FIGURE 12A

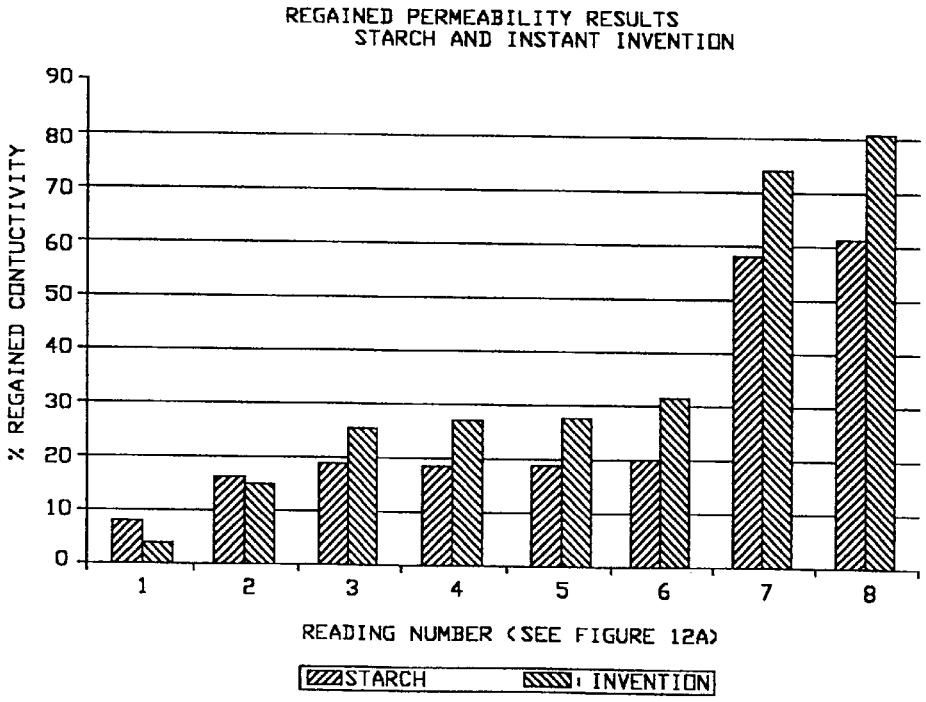

FIGURE 12B

INJECTION MOLDED DEGRADABLE CASING PERFORATION BALL SEALERS FLUID LOSS ADDITIVE AND METHOD OF USE

This is a continuation-in-part of U.S. patent application Ser. No. 09/055,549 filed on Apr. 6, 1999, now U.S. Pat. No. 5,990,051.

TECHNICAL FIELD OF THE INVENTION

The instant invention relates to a degradable composition, method of manufacture and method of use for ball sealers, which are used for temporarily sealing casing perforations, and a fluid loss additive, which is mixed with fluids for temporarily sealing formation fissures. In particular the invention relates to wellbore stimulation treatments in the oil and gas industry.

BACKGROUND OF THE INVENTION

Produced fluids (fluids are defined as liquids and gases) coming from a wellbore in the oil and gas industry are drawn from subterranean formations. The formation itself tends to restrict the flow of its own fluids, and the industry has defined a parameter which measures the tendency of fluids to flow under unequal pressure within a formation called permeability. Thus, the industry is interested in the permeability of a producing formation and employs techniques to maximize the permeability. There are several factors which affect the permeability of the formation which includes the effect of pores (the interstitial structure of the formation—namely voids, holes and other spaces), the effect of other fluids within the formation, and the effect of pore throats. Pore throats are essentially small pores within the formation.

After the actual drilling of a wellbore is complete, and if the well is successful, the industry performs an operation called completion. Completion is a series of involved operations and includes casing of the wellbore (running a steel tube from basically the bottom of the wellbore to the surface), cementing the casing in place within the wellbore (this operation fills voids between the steel casing and the formation strata and assures that one or more zones will not be in direct communication except through casing perforations), explosive perforation of the casing (punching holes through the steel tube and cement into the subterranean formation at the points where produced fluids are located), followed by cleaning and stimulation of the particular producing formation or formations.

Perforation involves the controlled explosive release of gases which are designed to penetrate the casing, penetrate any cement, and penetrate the subterranean formation immediately next to the casing. The penetration into the formation is dependent on the size of the charge, the type of formation (sand, sandstone, etc.), the size and thickness of the casing, and myriad other parameters; thus, the perforation extending from the casing into the formation ranges from a couple of inches to several feet. The term "perforation" as used in the industry generally refers to the holes punched in the casing. It is assumed that the perforation operation will "punch" circular holes through the casing and cement into the formation. Most of the time this assumption is true; however, perforations can be irregular in shape.

After the perforation operation is complete, and as part of well completion the wellbore and the producing formation (or formations, in the case of multiple zones) must be cleaned and prepared for production. This series of operations are designed to remove remaining wellbore cuttings (the ground formation strata due to the drilling operation), remaining drilling fluids which are trapped behind the casing and in the production zone or zones, and stimulate the production by increasing the permeability. These operations are run from the surface and involve pumping various fluids, including acids, surfactants and other stimulation and cleaning fluids, down the wellbore into the production formation. The fluids will pass through perforations in the casing and into the formation. After a period of time, pressures are reduced so that the fluid will back-flow and draw impurities back into the wellbore and up to the surface. Sometimes the operator must pressure stimulate the producing zone (or zones) which requires pumping a fluid such as an acid, liquefied gas, a sand slurry, a viscous liquid, or another liquid into the wellbore under high pressure. The high pressure fluid flows through the casing and cement perforations and into the formation where the high pressure causes the formation to crack or fracture; hence, the name fracturing is used to describe this operation.

There is one substantial drawback in the initial cleaning and stimulation operations. The fluids will readily flow through the casing perforations and into the formation wherever the formation permeability is high. Thus, wherever the permeability is low a fracturing treatment is an economic necessity. Stimulation fluids will flow most easily into the high permeability zones. Extra pressure will be required to force the fluids into the lower permeability part of the formation. This extra pressure will in turn force additional fluids into zones which already have high permeability and could damage those zones by excess fluid leak off. In the case of acid fracturing (a high pressure operation) the possibility of damage to production formation is substantially increased. Thus, a method for diverting, controlling or directing the flow of stimulation or cleaning fluids into the formation through casing perforations is required.

After the wellbore is placed in service and as the produced fluids flow through the formation, the produced fluids draw other materials along which often precipitate out (or just drop out) of the fluid. These materials will block the pores; thus, decreasing the permeability over time.

After a period of time, the operator of the wellbore must return to the site and treat the formation again to improve the permeability and production rate. These secondary stimulation treatments are similar to the initial treatments and generally include acids and surfactants, both of which are pumped into the wellbore and into the formation. During these secondary treatment operations, the areas of the formation where the permeability has decreased should be treated. Unfortunately, the treating fluids will flow most readily into the formation with the highest permeability—namely where the fluids are not needed, which is the same problem encountered during the initial treatment. In limited cases fracturing is again used and the danger of formation damage reappears. Thus, it is desirable to control or divert fluid flow into the regions with high permeability while forcing the fluids into regions of low permeability.

The industry has developed a product and method to control and direct treatment fluids through casing perforations and into the production zone or zones. The product is called a ball sealer: in reality a series of ball sealers which are capable of plugging the casing perforations. The ball sealers are slightly larger than the casing perforation and are capable of shutting off fluid flow through the casing perforation if and when they fall in front of a perforation. (The art is placing the sealers in the wellbore so that they will seal a perforation at the right time.) The associated method involves pumping the ball sealers into the wellbore along with the treatment fluids in an orderly manner so that they plug the offending perforation at the right time.

The standard method of use requires that the ball sealers be staged in the stimulation fluid as it is pumped into the wellbore. For example, assume that a simulation treatment requires 24 barrels (1,000 gallons) of fluid, and it is known that there are 24 perforations in the wellbore; thus 48 balls will be required. (The operator generally doubles the number of perforations to determine the number of balls.) In this example, the operator would release one ball for each one-half barrel pumped into the wellbore. This will help assure that each perforation is treated with an adequate amount of stimulation fluid before the next ball contacts the next perforation sealing it prior to increased fluid pressure breaking down (opening up) the next unsealed perforation and treating the formation associated with that perforation. The sequence of seal a perforation, treat the next, seal that perforation, treat the next, etc. continues until all the perforations have been ideally treated. At the surface, the operator will note a slight increase in pressure as one perforation is sealed and until the next formation opens up under pressure with an associated pressure decrease. The actual order of perforation treatment will not be from bottom to top, but will be associated with the order in which a given formation associated with a given perforation opens up. Ideally, at the end of the operation, all perforations seal and a sharp pressure increase is seen at the surface: this phenomena is called "balling out" and indicates that all perforations have been treated.

Once the initial or secondary operations are complete, the ball sealers fall away from the perforations (due to flow from the formation into the wellbore) and generally remain in the wellbore where they become a nuisance and present operational problems. Most wellbores contain a 'rat hole' which is an extension of the wellbore below the lower casing perforation about 20 plus feet in depth. (In some wellbores this rat hole can become filled with debris and no longer exists.) The balls fall into the rat hole, where, under some circumstances one may be picked up by the motion of the produced fluid and carried to surface. At the surface a renegade ball can plug the surface production valves creating a safety hazard. Some operators will place "ball catchers" at the surface to avoid this problem. Often the wellbore operator must reenter the hole with drilling tools and the excess balls surround the drilling pipe or downhole tools jamming the pipe or tools in the wellbore. This results in an expensive "fishing" operation to retrieve the jammed tools.

Ball sealers are but one product used in treating a wellbore and the associated production zones. As previously mentioned a stimulation fluid is pumped into the wellbore under pressure which penetrates the formation and hydraulically fractures the formation. Hydraulic fracturing is well understood in the industry and is used with old wells and new wells to increase the production rate by changing radial flow to linear flow and bypassing near wellbore damage. The process is not simple and does not involve a simple fracturing liquid.

A typical fracture treatment fluid would comprise a thickened fluid such as an aqueous gel, emulsion, foamed fluid, gelled alcohol, or an oil based fluid. This "base" increases the hydraulic effect and generally supports additional materials called "proppants". Proppants are designed to remain in the fractured formation and "prop" the fractures open. A properly designed proppant is pumped into the fracture by the fracturing fluid to form a highly porous matrix through which the formation fluid may readily pass to the wellbore.

Another problem will occur in most fracturing operations, which causes considerable grief to the operator. A producing formation occurs in more or less horizontal layers which undulate. These layers can range from several feet to several hundred feet thick. As the fracturing operation proceeds, the fractures may propagate vertically out of the target zone. This allows the fracturing fluid to move into a non-producing formation located above and/or below the producing formation. Usually the non-producing formations are shale layers or permeable zones with little gas or oil content. Total fluid loss is defined as the amount of fracturing fluid lost to the total area of exposed formation of the created fracture and is well known and understood in the industry. Fluid loss must be controlled; otherwise, the fracture width will not be sufficient to allow the proppants to enter the fracture and keep it propped open (or sand out can occur).

Therefore, additional materials are placed in the fracturing liquid to limit fluid loss. These materials are termed "fluid loss (fluid-loss) additives" and are well known in the industry. Unfortunately, a fluid loss additive is designed to slow fluid lost to the formation by bridging over pores, fissures, etceteras, which reduces the permeability of the formation to the fluid. The very opposite of the end result that is desired in a hydraulic fracturing operation. These fluid loss additives are carefully formulated to break down within the formation after the fracturing operation is complete. Some of the breakdown occurs because the additive goes back into solution or additional chemicals are pumped into the formation to make the additives break down. This "after-process" is termed cleanup in the industry. The current additives produce "cleanup" that varies greatly from well to well in the field.

PRIOR ART

As stated above, ball sealers and the method of use have been known to and utilized by the industry for many years. The early ball sealers were usually made from a solid core with an outer coating made from rubber or a similar polymer coating. The core and coating were chosen so that the ball would be slightly buoyant in the stimulation fluid—be it acid or surfactant based. These balls were then added to the stimulation fluid at appropriate times during the stimulation operation and suspend themselves in the stimulation fluid. The balls are then carried down into the wellbore and plug off perforations which are in communication with high permeability strata; thus, diverting the stimulation fluid to perforations in communication with low permeability strata. The rubber/polymer coated ball sealers would remain in the wellbore and caused problems such as reported in the previous section.

The problems associated with the ball sealers remaining in wellbore have been addressed in a number of ways. One of the ways was to add a ball catcher at the surface; however, this solution did not address the problems caused by the balls when reentering a wellbore for certain drilling operations. U.S. Pat. No. 4,716,964 to Erbstoesser et al. discloses a method for using biodegradable ball sealers in a wellbore. The method patent is a continuation of a division of its U.S. Pat. No. 4,387,769 which disclosed a method for reducing the permeability of the actual formation during stimulation operations. The biodegradable ball sealer is disclosed in U.S. Pat. No. 4,526,695 which discloses and claims a biodegradable ball sealer. Erbstoesser discloses and claims a solid polymer ball sealer with the polymer being substantially insoluble in a stimulation fluid and degradable in the presence of water at elevated temperatures to oligomers which themselves are at least partially soluble in oil or water. Ball sealers following the Erbstoesser disclosure do not appear to be available on the market. The actual reason for lack of availability is not known; however, it is believed that the sealers using the Erbstoesser technology tend to break down too early or they cannot hold up under the stimulation pressures experienced in a wellbore. For example, if a ball sealer is extruded through a casing perforation into the formation, and /or cement seal lying immediately next to the casing, and if the compound will not readily breakdown in the wellbore fluid, that perforation will have problems. Erbstoesser (see U.S. Pat. No. 4,716,964) hints that such problems may occur with pressure differentials of 200 PSI and at temperatures in the range of 150 to 160 degrees Fahrenheit.

Kendrick et al. in U.S. Pat. No. 5,253,709 attempted to address the problem caused by irregular shaped perforations. Kendrick proposed a hard center ball with a deformable outer shell which would deform to the irregular shape of a casing perforation. The inner core is manufactured from binders and wax that is to melt at downhole temperatures; whereas the outer covering is a rubber. The ball would then pop loose from the casing perforation after a period of time; however, nothing is mentioned as to a degradable outer surface, and it would appear that the balls would remain intact in the wellbore.

There are other problems associated with the current generation of ball sealers. One of these problems is apparent in low pressure wells. After the well is treated using ball sealers, the formation pressure is insufficient to push the balls out of the casing perforations due to simple hydrostatic fluid pressure caused by the fluid head in the wellbore. If the balls do not readily break down a mechanical scrapper must be run down the wellbore or the well will not produce and the stimulation operation would be wasted.

Thus, there remains a need for an improved ball sealer (1) that is capable of diverting fluid flow from casing perforations which are in communication with highly permeable strata to perforations which are in communication with low permeability strata, (2) that will readily degrade in the stimulation fluid at the elevated temperatures found in wellbores but only after the stimulation process is complete, (3) that will degrade by becoming soluble in the fluids found in wellbores, (4) that is capable of deformation to conform to an irregular-shaped casing perforation, and (5) retain its strength and not extrude through a perforation casing while the stimulation process is underway.

In the area of compounds used in applications within and without the oil industry, U.S. Pat. No. 4,064,055 to Carney discloses an Aqueous Drilling Fluids and Additives Therefore which teaches a friction reducer using some of the compounds disclosed in this invention. U.S. Pat. No. 3,971,852 to Brenner discloses a Process of Encapsulating an Oil and Product Produced Thereby which teaches the process of encapsulating oil (perfumes) in a solid matrix.

In the area of compounds used in fluid loss additives, U.S. Pat. No. 5,032,297 to Williamson et al. discloses an Enzymatically Degradable Fluid Loss Additive which teaches the addition of an enzyme to the standard fluid-loss inhibitors comprising a mixture of natural and modified starches which are broken down by the enzyme; however, the enzyme does not affect the guar (a natural polymer) used in the fracturing fluid. One of the earlier patents, U.S. Pat. No. 3,319,716 to Dill, discloses a Fluid Loss Additive for Well Fluids, Composition and Process. This patent discusses the use of ground oil soluble resins in guar and gums; however, it does not discuss the concept of biodegradable additives.

U.S. Pat. No. 5,246,602 to Forrest discloses a Method and Composition Fracturing Subterranean Formations, which teaches the addition of finely ground peanut hulls within a certain mesh distribution to the fracturing fluid to act as an additive.

U.S. Pat. No. 5,301,751 to Githens et al. discloses a Method for Using Soap as a Soluble Fluid Loss Additive in the Hydraulic Fracturing Treatment of Oil and Gas Wells, which teaches the use of biodegradable soap to act as a loss-inhibitor and cleanup agent in conjunction with normal polymers and other agents. U.S. Pat. No. 5,354,786 to Lau discloses a Fluid Loss Control Composition which teaches a polymer composition containing halogen-substituted organic acids or salts which hydrolyze after the fracture operation is complete. The hydrolyses reaction in turn releases hydrogen-halogen acids which in turn break down the polymer, thus, cleaning up the formation.

U.S. Pat. No. 5,415,228 to Price et al. discloses Fluid Loss Control Additives for Use with Gravel Pack Placement Fluids which teaches the use of carefully distributed soluble particles (calcium carbonate) to achieve fluid loss control. U.S. Pat. No. 5,439,057 to Weaver et al. discloses a Method for Controlling Fluid Loss in High Permeability Formations which teaches a cross linked polymer gel broken into discrete particles and dispersed in the fracturing fluid. The resulting fluid interacts with the formation and fracturing fluid constituents to form the required fluid-loss control filter cake.

Thus there still remains a fluid-loss additive that is degradable within the formation using natural fluids occurring in the formation or in the fracturing fluid and which produces substantially improved "clean-up" over the existing art. Further, there is real need for a fluid loss additive which itself does not permanently damage the formation resulting in reduced permeability and thus lower production rates from the well.

SUMMARY OF THE INVENTION

The present invention relates generally to a composition of matter and method of manufacture used for degradable ball sealers and/or a fluid-loss additive to be utilized in the oil and gas industry. The present invention comprises an injection molded ball sealer and/or fluid loss additive both of which are comprised of a mixture of thermosetting adhesives and fillers which are soluble in water, surfactants and other aqueous based fluids found in most wellbores over a controlled period of time. For purposes of explanation, but not as a limitation, the filler material consists of glycerin, wintergreen oil, oxyzolidine, oil, and water.

The ball sealer of the present invention is manufactured in a two step process. First a slurry comprising the preferred composition consisting of collagen and fillers is mixed and allowed to set up. The resulting composition is ground and sent to an injection molding device, using standard and known techniques, to be formed into balls having a diameter that is somewhat greater than the wellbore perforation. (Various diameters are produced but not usually exceeding 1.5 inches in diameter. This must not be read as a limitation, for if the balls are used to temporarily seal a production tubing, then the balls will have a greater diameter.) The ensuing balls will have a specific gravity in the range of 1.1 to 1.2. The specific gravity must not be read as a limitation for the specific gravity may be adjusted to fall in the range 0.5 to 2 depending on the mix of the composition used to manufacture the balls. Thus, the resulting ball comprises a round, solid, smooth surfaced seal ball with suitable characteristics that allow it to soften slightly on its surface in the presence of the stimulating fluid; thus, assuring a solid contact with the casing perforation, through controlled surface deformation, throughout the casing perforation. The core of the ball retains its strength until the stimulation operation is complete. Sometime after the operation is complete and certainly within a reasonable period of time, the balls will degrade and go into solution.

The fluid loss additive is manufactured using one of two processes. Ball sealers which are improperly shaped (out of specification) are ground up to form particles in the distribution range of −80 mesh to +270 mesh. Alternatively, the compound used for manufacture of ball sealers is poured into thin sheets (conveniently sized for handling) and dried in an oven or kiln. (This drying process produces a similar effect as does injection molding and drying of the ball sealers.) The particles are mixed in the ratio of 20 pounds mass to 1000 gallons of fracturing fluid, although this proportion can and will be adjusted by those skilled in the art of fracturing. Standard techniques are then used to fracture the formation with the additive forming the usual filter cake against the fracture face. After the fracturing operation is complete, and just like the ball sealers, described above, the fluid loss additive breaks down within the formation fluid. This then allows the filter cake to fall away from and disperse from the fracture face which results in a better than usual initial cleanup. Standard cleanup techniques are then utilized with fracturing fluids containing ammonium persulphate, or equivalent, to achieve cleanup results which are substantially better than the current art allows.

Thus, the first objects of this invention to provide a degradable ball sealer which will properly and completely seal casing perforations have been met. The ball sealers will break down in an aqueous fluid and therefore they can be used in a low pressure well, and the ball sealers could be used to temporarily plug the perforations during certain wellbore operations in which a wellbore fluid (e.g., mud) which is harmful to the producing formation is used. Thus, the second objects of this invention, which stem from the properties of the composition, to provide a degradable fluid loss additive have been met. The fluid loss additive will break down in an aqueous solution leaving little damage to the formation. These and other objects and advantages of the present invention will become apparent to those skilled in the art after considering the detailed specification in which the preferred embodiments are described. In particular the use of the balls to seal production tubing for pressure testing.

BRIEF DESCRIPTION OF THE DRAWINGS

FIG. 5 gives the results of a dissolution test run on a series of ball sealers using the composition of the instant invention.

FIG. 6 gives the results of a pressure test run on a series of ball sealers using the composition of the instant invention.

FIG. 7 is a table listing the elements forming the composition of matter for the instant invention and showing both the possible range and the preferred range of the separate constituents for the composition of matter.

FIG. 12A is a table showing the laboratory comparison results between standard starch and the instant invention.

FIG. 12B is a graph showing laboratory regained permeability results (cleanup) for standard starch and the instant invention.

DESCRIPTION OF THE PREFERRED EMBODIMENT

Figure 1:
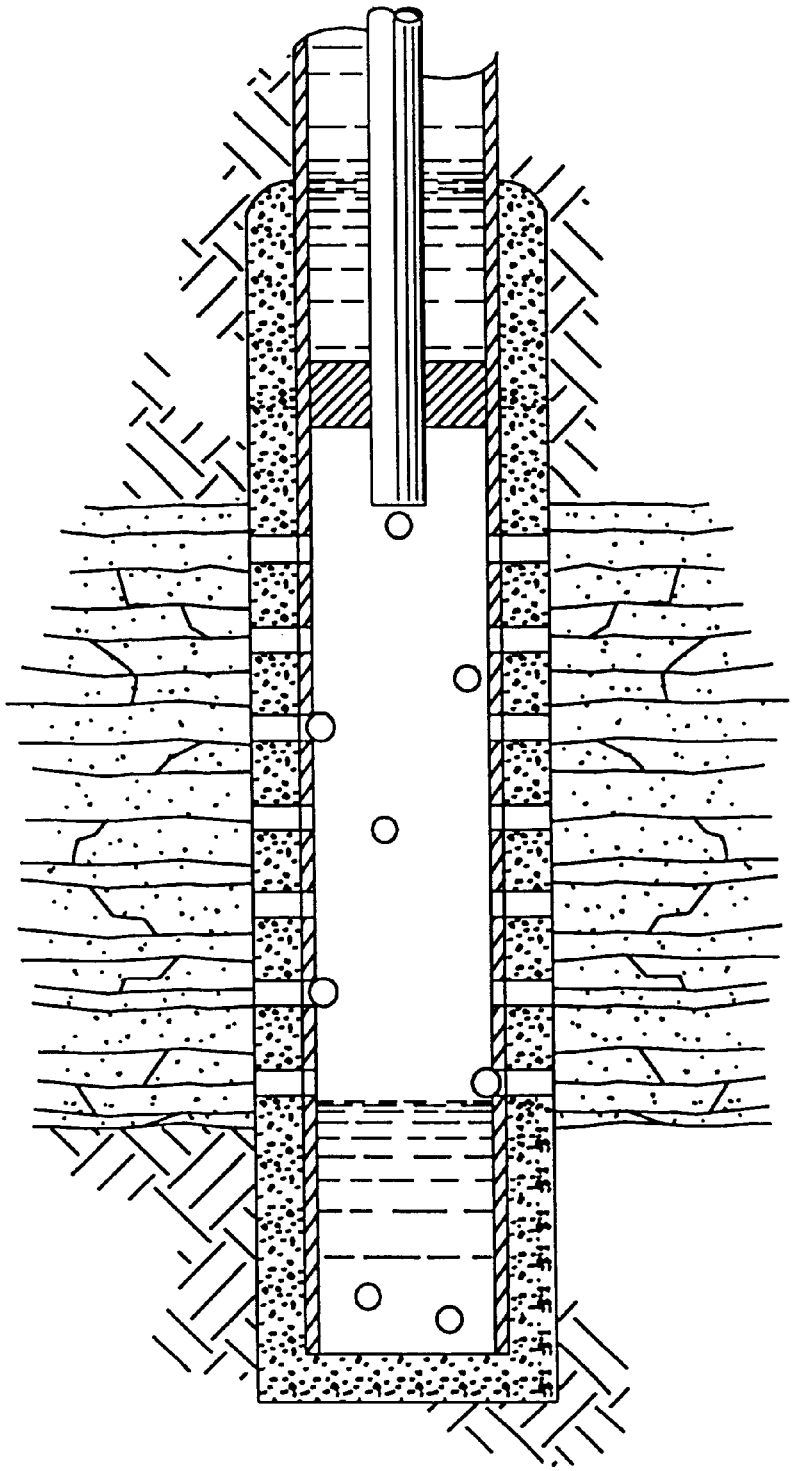
FIG. 1 is a diagrammatic sectional view of a wellbore showing perforations from the casing, through the cement and into the formation as well as illustrating the "rat hole", containing several ball sealers, at the bottom of the wellbore.

The preferred mixture to injection mold the ball sealer and/or fluid loss additive of the present invention comprises a soluble filler material and adhesives that when combined, and allowed to cure, will provide the required neutral mass and strength for ball sealer and/or fluid loss additive that forms the instant invention. For purposes of explanation, but not as a limitation, the filler material consists of glycerin, wintergreen oil, oxyzolidine, oil (animal, vegetable or mineral), and water. The preferred oxyzolidine is ZOLDINE® basically 5-HYDROXYMETHYL-1-AZA-3,7-DIOXABICYCLO (3,3,0) OCTANE (55%) and WATER (45%). Other fillers may be added as needed and as explained later in this disclosure. The adhesive consists basically of collagen. The mixture is prepared by blending the collagen with the other elements in a proper ratio, as explained later in this disclosure, to form a viscous slurry suitable for injection molding or pouring into thin slabs. The mixture is thermosetting because of the combined properties of the constituents forming the composition of matter. Although not a part of the initial development, it is possible to add dyes at the time of mixing the slurry to indicate the specific gravity and/or the solubility time for the composition of matter forming the ball sealer. The prototype balls have a specific gravity in the range between 1.1 to 1.2 and ideally should have a specific gravity close to the fluid being used in the wellbore so that the balls will almost, but not quite, float in the wellbore fluid.

The viscous slurry must be carefully controlled for two reasons. First the dry slurry must have suitable properties for injection molding equipment, and second the composition of matter must, after injection molding and curing, exhibit the required properties expected of a ball sealer. It is known that glycerin and oil serve almost a similar function within the mixture. The oil (preferably mineral oil; however almost any heavy petroleum product or animal or vegetable oils may be used) serves to elongate the dissolution time when the ball is in the wellbore. Glycerin helps stabilize the ball during curing and can be replaced with oil.

The slurry is mixed in a carefully controlled temperature range varying between 56 to 214 degrees Fahrenheit and allowed to set up. The composition is then ground (a standard operation in the injection molding process) to a suitable size that allows the composition of matter to be fed to an injection molding machine containing a mold. The mold should have the form required for the particular ball size. Standard injection molding techniques are used, and any person who is skilled in the art of injection molding will be able to produce the balls; however, care must be taken in feeding the injection molding machine with the composition. It has been noted that relative humidity affects the operation, but a skilled operator can take the daily changes into account.

The mold will generally produce a plurality of balls and may be changed out to produce ball of various diameters. Standard mold manufacturing techniques are employed, and any person with skill in the art will be able to produce a suitable mold for an injection molding machine.

The mold temperature is held between 67 to 214 degrees Fahrenheit, and the injection pressure ranges between 100 to 2,000 PSI. (Those familiar with the art of injection molding know that pressure and injection temperature are interrelated. It is important to maintain the stated temperature range.) The temperature range is again dependent on relative humidity, and a skilled operator will be able to make the necessary adjustments. The formed ball(s) is(are) held within the mold cavity for a sufficient period of time to assure that thermosetting takes place. The mold is opened and the seal balls are removed and sent to storage for additional curing of at least two weeks. The actual curing time varies because the thermosetting composition will form a tight (few voids) surface about the ball itself, thus, limiting the rate that residual moisture can leave the body of the ball. The ball is fully cured when it will not distort or flatten under external pressure. Basically, a person can feel when the ball is cured, because finger nails will not penetrate the surface nor will the ball feel soft. Furthermore, when dropped, a properly cured ball will bounce like a marble.

Figure 2:
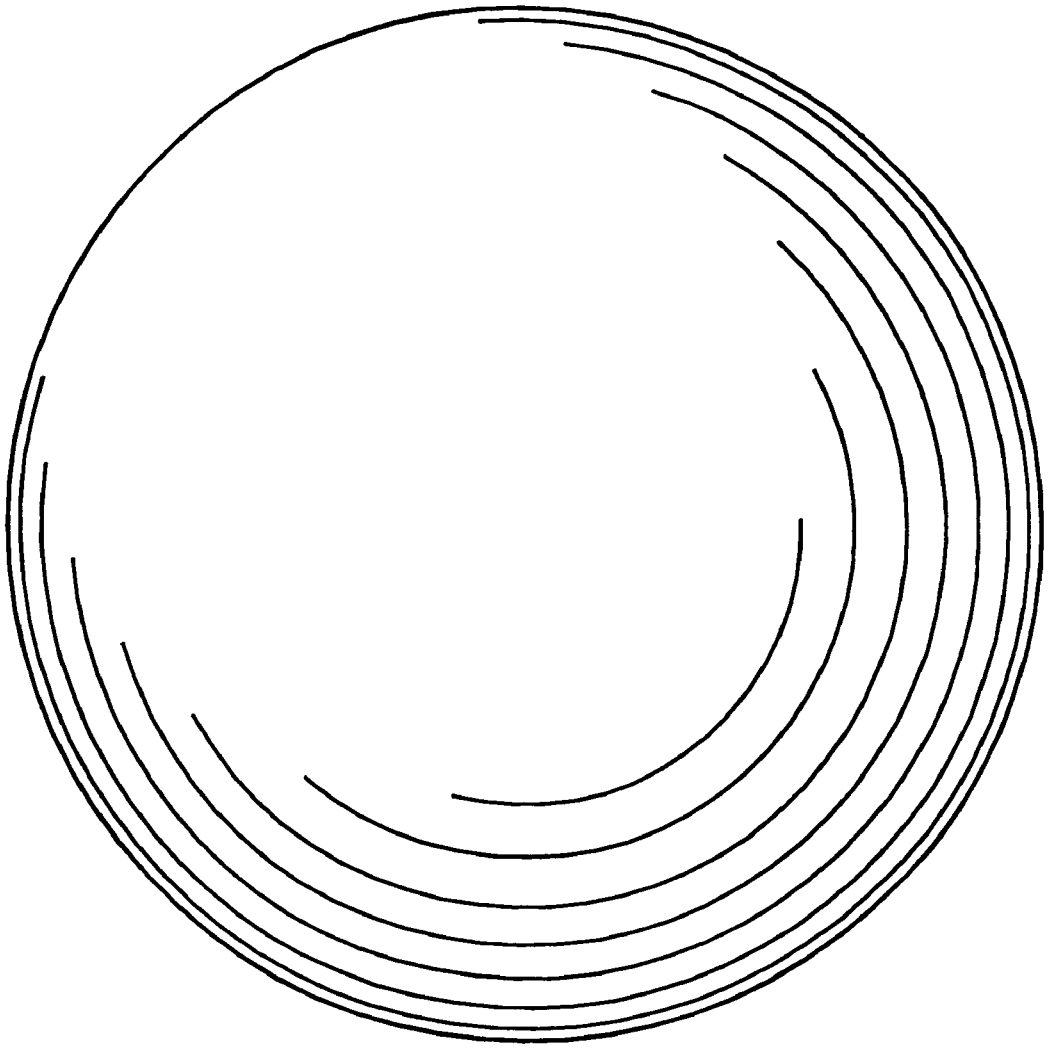
FIG. 2 is view of the instant injection molded invention.
Figure 3A:
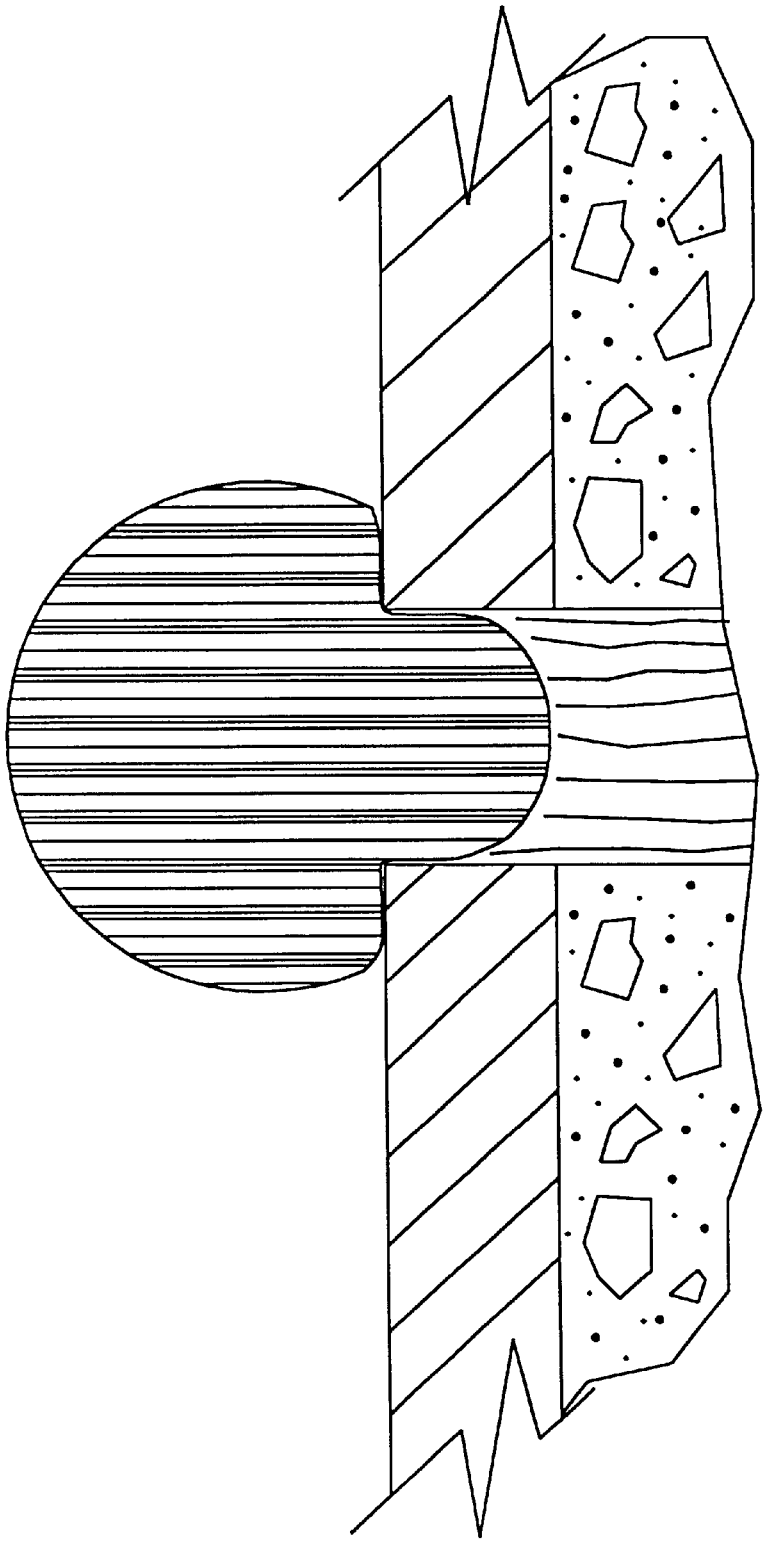
FIG. 3A shows a cross-sectional view of a ball sealer engaging a casing perforation.
Figure 3B:
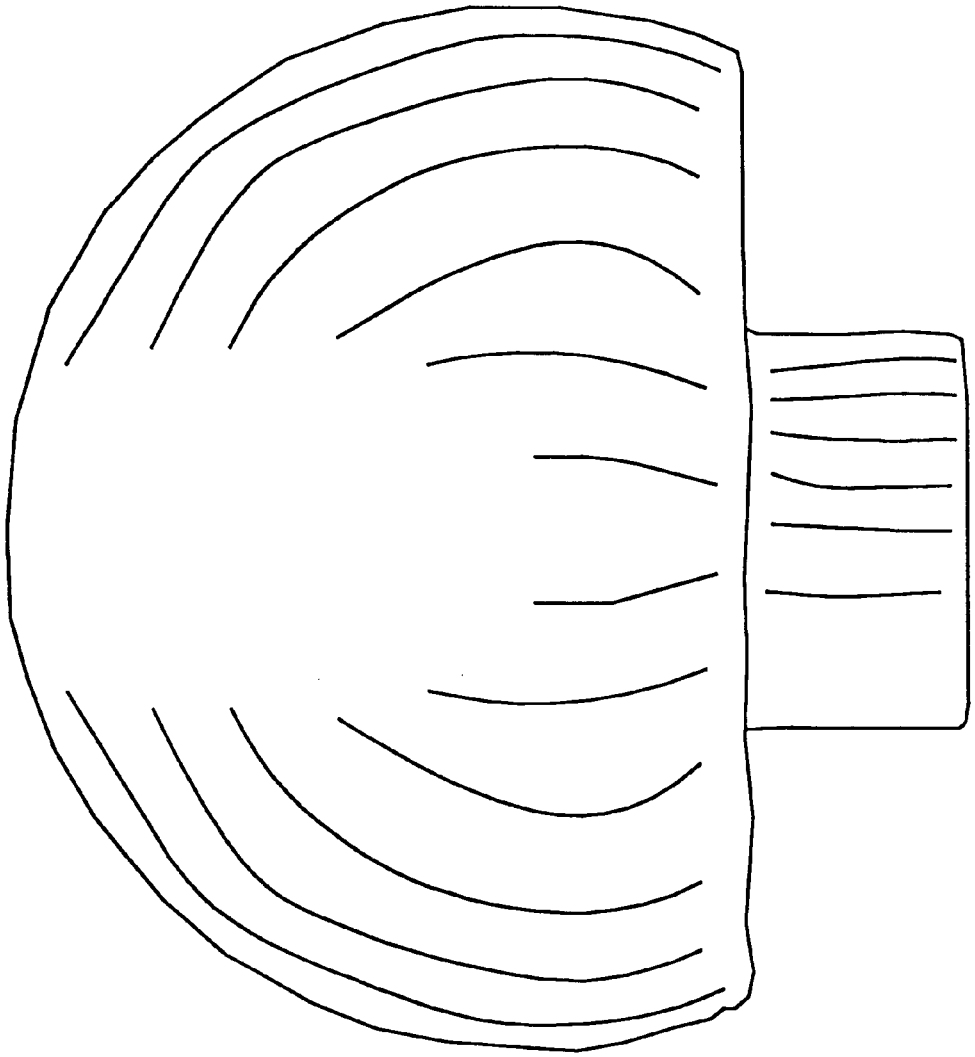
FIG. 3B shows a cross-sectional:view of a ball sealer after engaging a casing perforation.
Figure 4:
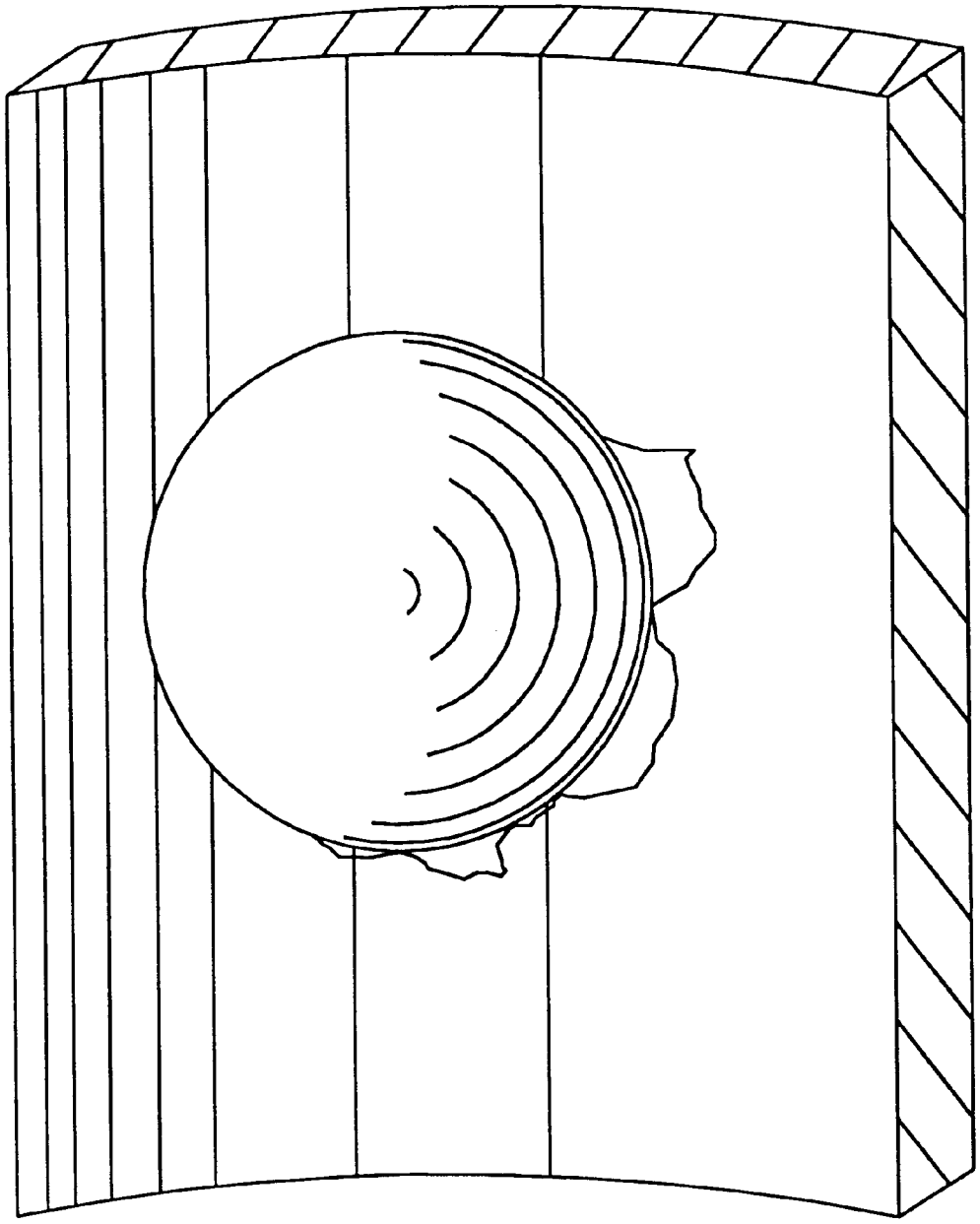
FIG. 4 shows a perspective view of an irregular-shaped perforation in the casing of a wellbore with a seal ball in place.

Upon completion of the process a plurality of degradable ball sealers having a mass between 0.25 to 1.25 ounces is produced. The diameter may be changed by changing the mold and should be chosen to meet the sealing condition that the ball perform under. (I.e., seal perforations or seal tubing.) The resulting ball (see FIG. 2) comprises a round, solid, smooth surfaced seal ball with suitable characteristics that allow it to soften slightly on its surface in the presence of the stimulating fluid; thus, assuring a solid contact, through controlled surface deformation, on the edges of the casing perforation. (See FIG. 3) The ball retains its strength until the stimulation operation is complete.

Figure 9A:
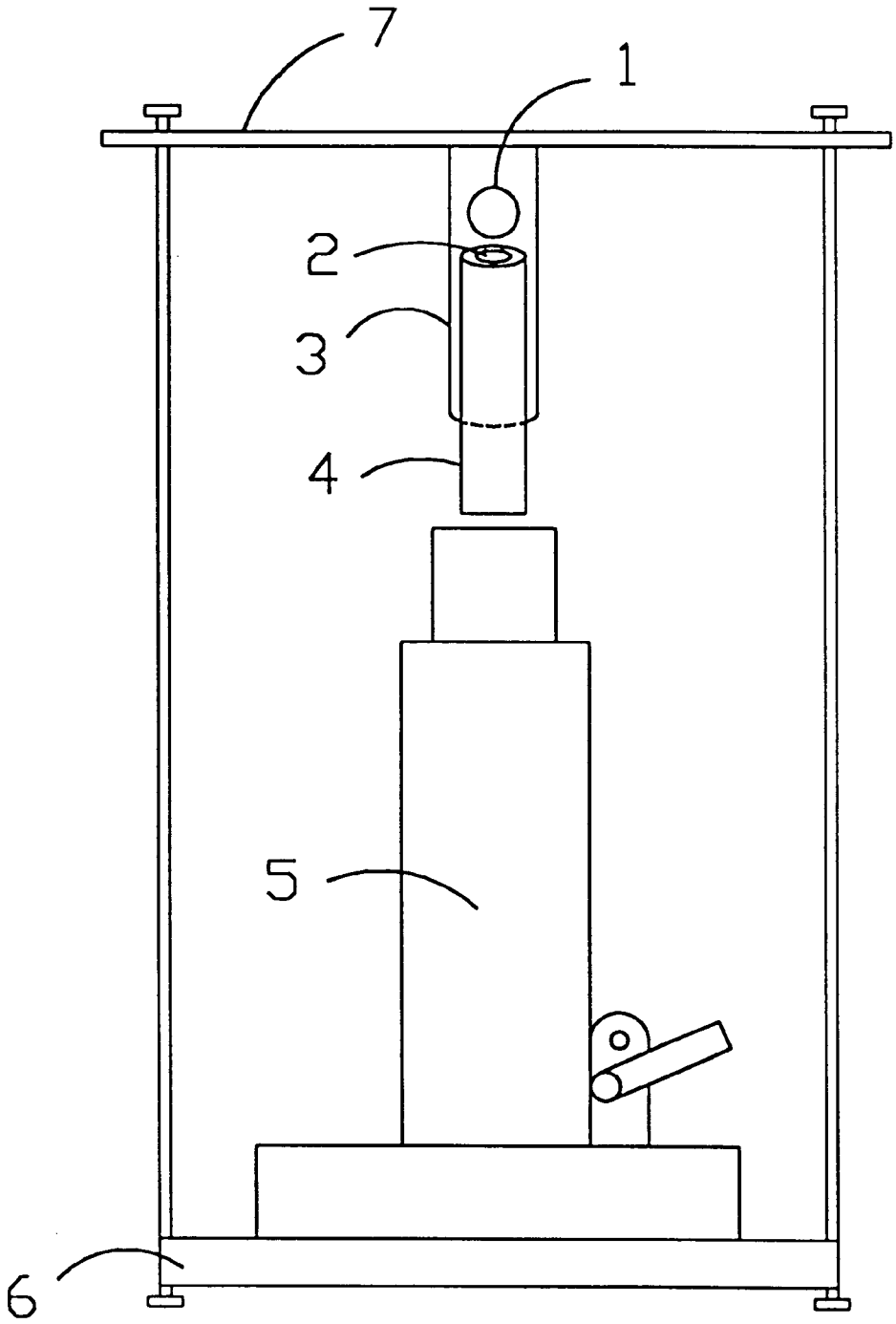
FIG. 9A is sketch of the one of the apparatuses used to "pressure-test" seal balls using the instant composition of matter.
Figure 9B:
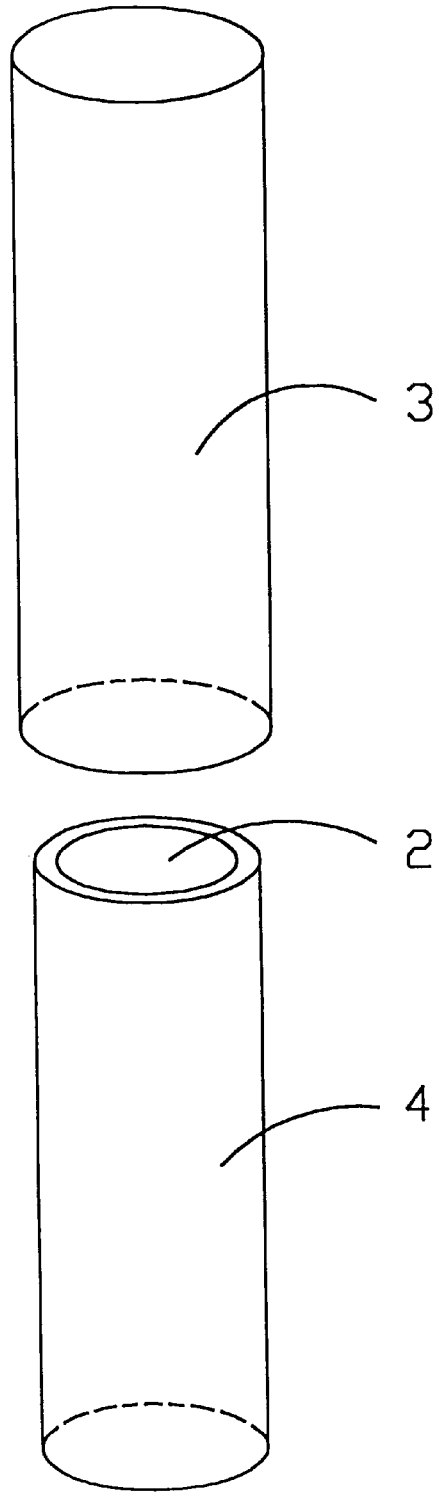
FIG. 9B is an expanded view of the test chamber.

The optimum composition of matter—namely the dried slurry mixture sent to the injection molding operation—the mixing temperature, and the molding temperature were determined through a series of trial and error testing. For example, if the slurry is mixed at too low a temperature, it was found that the ingredients would not properly mix and a weak ball resulted. On the other hand if the slurry was mixed at a very high temperature, the collagen would break down which also resulted in a weak ball. The inventors define a "weak ball" to be one that will not hold up in a wellbore (see FIG. 1) when plugging a perforation. As stated earlier, other filler materials may be used within the ball sealer and experience has shown that fiber glass threads may be incorporated into the slurry prior to injection molding. The fiber glass provides additional strength to the ball in high temperature/high pressure conditions and stops the ball from deforming within the perforation. A deformed ball often passes through the perforation and into the formation; thus, reducing the efficiency of the overall fracturing operation. In the case of ball sealers, the presence of minute threads of fiber glass, after the ball sealers degrade within the wellbore, is NOT detrimental as the wellbore fluids do NOT enter the formation being part of the produced fluids that return to the surface. It should be noted that any fiber which exhibits similar properties to fiber glass may be used. In fact, cotton or some form of degradable fiber could be employed. Ball strength testing, or pressure testing, was performed in a pressure jig (see FIG. 9) which comprised a hydraulic jack, 5, pushing a seal ball, 1, contained within a steel conduit, 3, against a steel washer, 2, with a ⅜-inch hole. Other parts of the apparatus consisted of a base, 6, a top plate, 7, and a moving section, 4, which hold the washer, 2. Later a pressure jig which allowed technicians to place a liquid differential pressure across a plate containing a single ball that was plugging a single ⅜-inch diameter round hole was employed. A typical series of test runs is shown in FIG. 6. Other experiments show that the ball will fail (push through the washer) after extended times at temperatures higher than 120° F. However, actual wellbore testing showed that the wellbore fluid would be close to the surface temperature as long as the stimulation fluid was being pumped down the wellbore. In other words, the stimulation fluid itself cools and maintains the ball sealers.

The prototype balls were also subjected to dissolution testing in normal stimulation fluids. FIG. 5 shows the results of one of a series of tests. In the dissolution tests four balls were placed in stimulation fluid held at room temperature (approximately 72° F.) for a long time. The balls were removed from the fluid and the diameter measured with a caliper. The starting diameter for the balls was approximately 0.89 inches.

In actual use and when the stimulation process is complete, the wellbore temperature will return to the downhole ambient temperature. This increase in temperature that the ball sealers experience and their tendency to naturally go into solution in wellbore fluids will cause them to degrade and go into solution within several hours.

Figure 8:
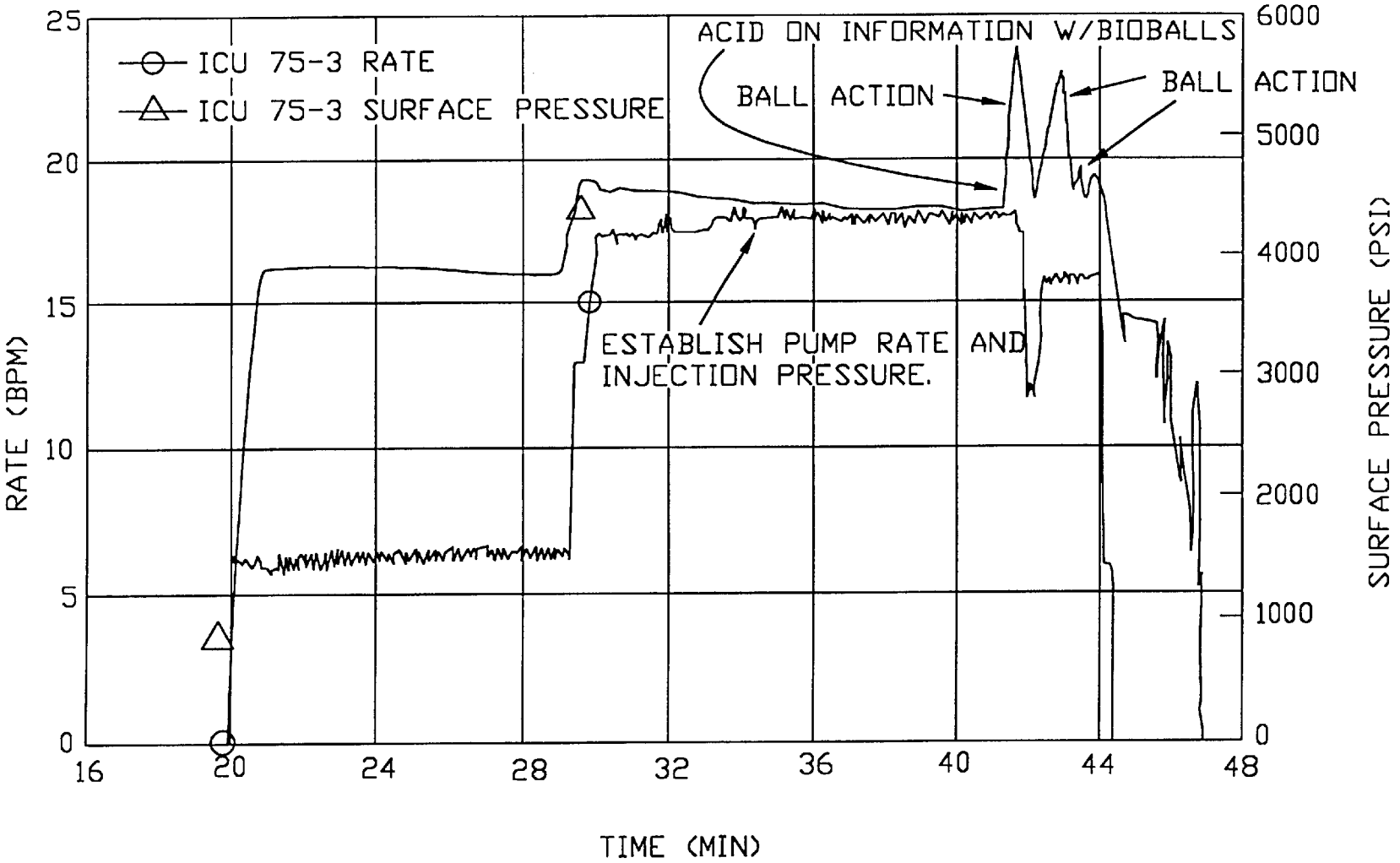
FIG. 8 is a copy of a chart made during the stimulation of a well showing the series of pressure changes and associated fluid flow that occur as the formation associated with a given perforation opens and is then sealed by a ball. Notations on the chart, made by the operator, show what is happening.

Actual field tests on a wellbore showed that ball sealers manufactured from the composition of matter disclosed held up to standard stimulation pressures for the duration of the stimulation process. (See FIG. 8.) It is not known exactly how much time was taken for the ball to completely degrade because one cannot "look" down a wellbore and make any measurements regarding the balls themselves. Based on test results and wellbore temperatures it was assumed that the balls went into solution after several hours. What was important—namely that the balls held pressures during the operation—was attained in the field tests.

The optimum mixture was determined by pressure testing (weakness) and dissolution testing. The optimum mixture is shown in FIG. 7. In a similar manner the optimum molding temperature was found by trial and error. The optimum temperature range is shown in FIG. 7. In the injection molding process, because injection pressure and mold temperature are interrelated, the injection process is run between 100 and 2000 PSI and the mold temperature is held to between 83 and 184 degrees Fahrenheit.

Laboratory testing showed that balls made with the composition of matter manufactured under the conditions given above will produce a ball sealer (1) that is capable of diverting fluid flow from casing perforations which are in communication with highly permeable strata to perforations which are in communication with low permeability strata, (2) that will readily degrade in the stimulation fluid at the elevated temperatures found in wellbores but only after the stimulation process is complete, (3) that will degrade by becoming soluble in the fluids found in wellbores, (4) that is capable of deformation to conform to an irregular-shaped casing perforation, and (5) that retains its strength and does not extrude through a perforation casing while the stimulation process is underway. Thus, ball sealers manufactured from the composition of matter and using the techniques disclosed meet the objectives of the disclosure.

The same ball sealers were used in multiple zone well, in which the production zone extended over 2000 feet. In the past, when this well was stimulated, the 2000 foot zone was divided into sections using "bridge plugs" to isolate one zone from another. A bridge plug is a device which is set in a wellbore and completely isolates one portion of the wellbore from another. The bridge plug can be removed by wire-line operations or by drilling it out. In a multiple zone well, the operator generally starts at the bottom of well and sets a packer above the zone to be stimulated. Stimulation operations for the lowest section then commence. Standard ball sealers are used with the fluid. Once the lower section is stimulated, a bridge plug is set at a point just below the next zone to be treated with the packer set just above the zone to be treated. Stimulation operations for this zone are then commenced. Standard balls are again used with the stimulating fluid. This process is repeated until the entire 2000 ft zone was treated. At the end of the stimulation process, the operator goes back in the well and drills out the bridge plugs. The operator often experiences a series of problems associated with the seal balls remaining in the wellbore. One operator in fact refuses to use ball sealers and bridge plugs because of the problems associated with the remaining seal balls. The operator attempts to stimulate a zone through high rate stimulation in the hopes that high fluid flow rate will open up low permeability section even though fluid is passing into other sections. The success is limited, but the operator does not have to contend with problems during the subsequent drilling operations.

The aforementioned operator was convinced to try seal balls using the instant composition. The usual method of setting bridge plugs, stimulating a section of the multiple zone, etc. was used. The seal balls performed exactly as expected—namely they held up to pressure for the required stimulation treatment time and degraded by the next day so that when the bridge plugs were drilled out, no problems were experienced. The operator was elated.

The prototype balls were manufactured with a specific gravity within the range 1.1 to 1.2. This range must not be read as a limitation for the composition of matter used to manufacture the balls may be adjusted to produce a range that falls within 0.5 to 2.0. The balls may be lightened by using a light weight filler such as pearlite. The balls may be made heavier by using a heavy weight filler such as sand. The filler elements that may be used to adjust specific gravity is limited only by the wellbore conditions and one's imagination. Wellbore conditions would limit the choice of filler because one would not want to use a filler that would or could damage the formation, add an unnecessarily hazardous material, etc.

Finally, in wellbore operations a production tubing is often run from the surface to the production zone (or zones) and the tubing is isolated from the casing. It is often necessary to pressure test the tubing and a steel ball is allowed to travel to the bottom of the tubing where it will seal the tubing. Pressure is then applied and the integrity of the tubing may be determined. Once this test is complete, the steel ball must be recovered. This is usually done by reverse flowing fluid down the casing and back up the production tubing while hoping that the ball will travel back to the surface. Often the ball stays in the tubing, which means that the entire string must be removed. A ball using manufactured from the instant composition of matter can easily be used in place of the steel ball. Pressure testing may be done and then time and temperature with degrade the ball; thus' opening up the tubing for production.

Figure 10A:
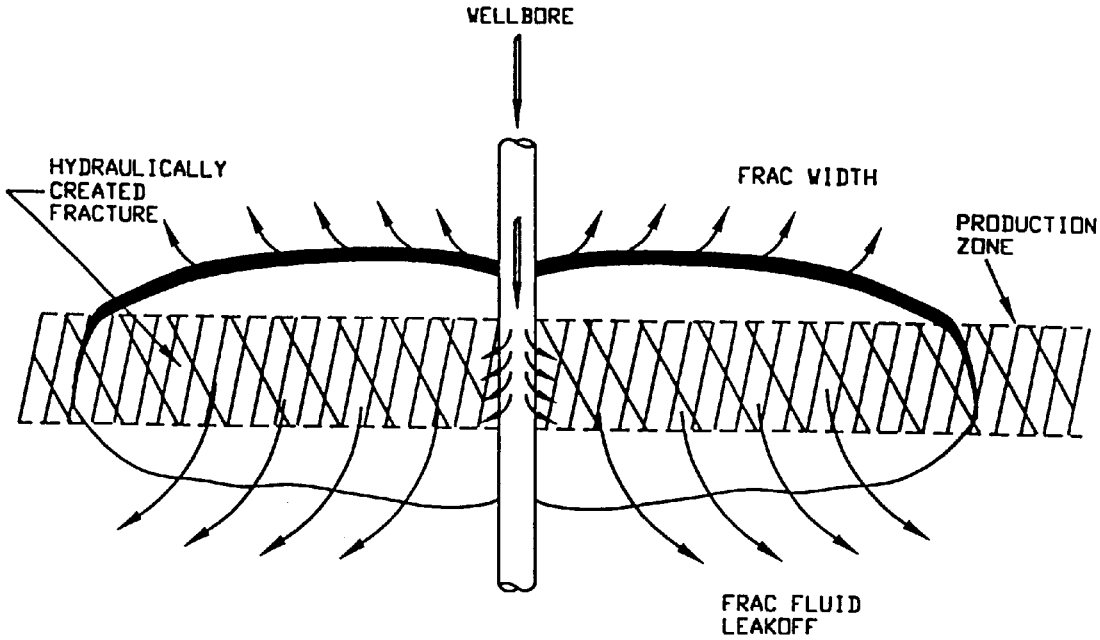
FIG. 10A is a simplified sketch of a hydraulic fracturing operation showing the wellbore, a vertical fracture and penetration of the fracturing fluid into the formation with additional penetration into the formations above and below the production zone.
Figure 10B:
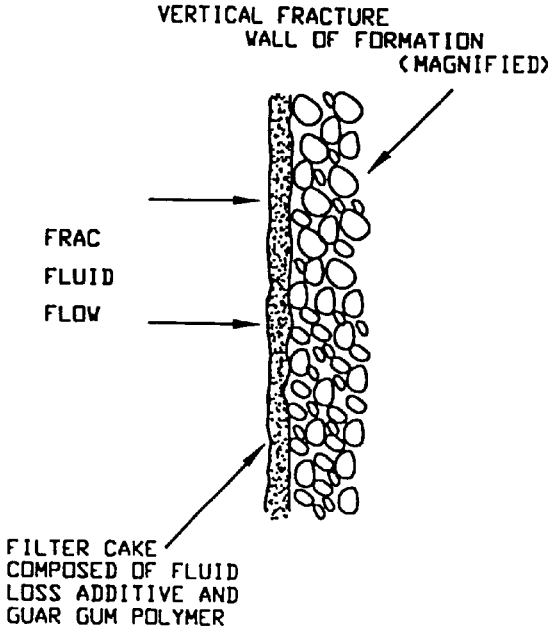
FIG. 10B is a simplified sketch of the fluid loss additive forming a filter cake against the pores of the formation.

The use of the composition of matter as fluid loss additive is shown in FIGS. 10A and 10B. The fluid loss additive is manufactured in one of two ways. First ball sealers which fail quality control (i.e., out of round, etc.) may be ground into particles having a distribution of −80 mesh +270 mesh as a powder. Alternately, the basic ingredients (using the same mixtures as for the ball sealers) are mixed together with 10 percent water by volume at 150 degrees Fahrenheit for about one hour. The resulting elastic material is then stretched into sheets about ¼-inch thick and dried in an oven (or kiln) at about 200 degrees Fahrenheit for at least one hour. (Lower drying temperatures may be required depending on the quality of the collagen, which must not be overheated to avoid breakdown of the polymer.) The resulting material is then broken up and ground in a high speed mill to obtain a particle distribution of −80 mesh +270 mesh. This powder (be it from rejected ball sealers or flat sheets) is mixed with the fracturing fluid and used in the well known industry manner. The preferred mix is approximately 20 pounds fluid loss additive to 1000 gallons of fluid. These proportions could be adjusted depending on the formation and the required operating conditions. Again those skilled in the art would know what adjustments to make. After the fracturing operation is complete, standard industry methods would be used to cleanup.

The powder can be mixed with oil or refined oils (such as diesel fuel, corn oils, and the like) and sold in drums. The liquid additive would be mixed with the fracturing fluid and used in the standard industry manner. It should be noted that the fluid loss additive may be mixed with standard fluid loss additives, such as starch. A mix of these materials may result in reduced cleanup, compared to a pure inhibitor, but will certainly result in an improvement over the current art.

The instant invention has undergone extensive testing in the laboratory and compared to standard starch. The fluid-loss inhibitor of the instant invention comprising a mixture of collagen or industrial gelatin (95%), glycerol or glycerin (4%), wintergreen oil or methylsalicylate (0.3%), oxyzolidine (0.2%), and corn oil (0.2%) (although any oil animal, vegetable or mineral could be used), were mixed with about 10% volume of water. (Again, the preferred oxyzolidine is ZOLDINE® basically 5-HYDROXYMETHYL-1-AZA-3, 7-DIOXABICYCLO (3,3,0) OCTANE (55%) and WATER (45%).) As stated earlier, the mixture was mixed in a dough mixer at 150 degrees Fahrenheit, drawn into elastic sheets of about ¼-inch thickness, dried in an oven at about 200degrees Fahrenheit for about one hour. It was then broken into chunks and ground into a −80 mesh +270 mesh powder. Tests were then performed on a 4 milli Darcys (mD) outcrop sandstone to evaluate the comparative performance of the instant biodegradable fluid loss system, starch and silica flower. Static leak off tests were run at 2000 psi, 150 degrees Fahrenheit using a generic 30 lb/1000 gallons linear guar (polymer) solution.

Figure 11:
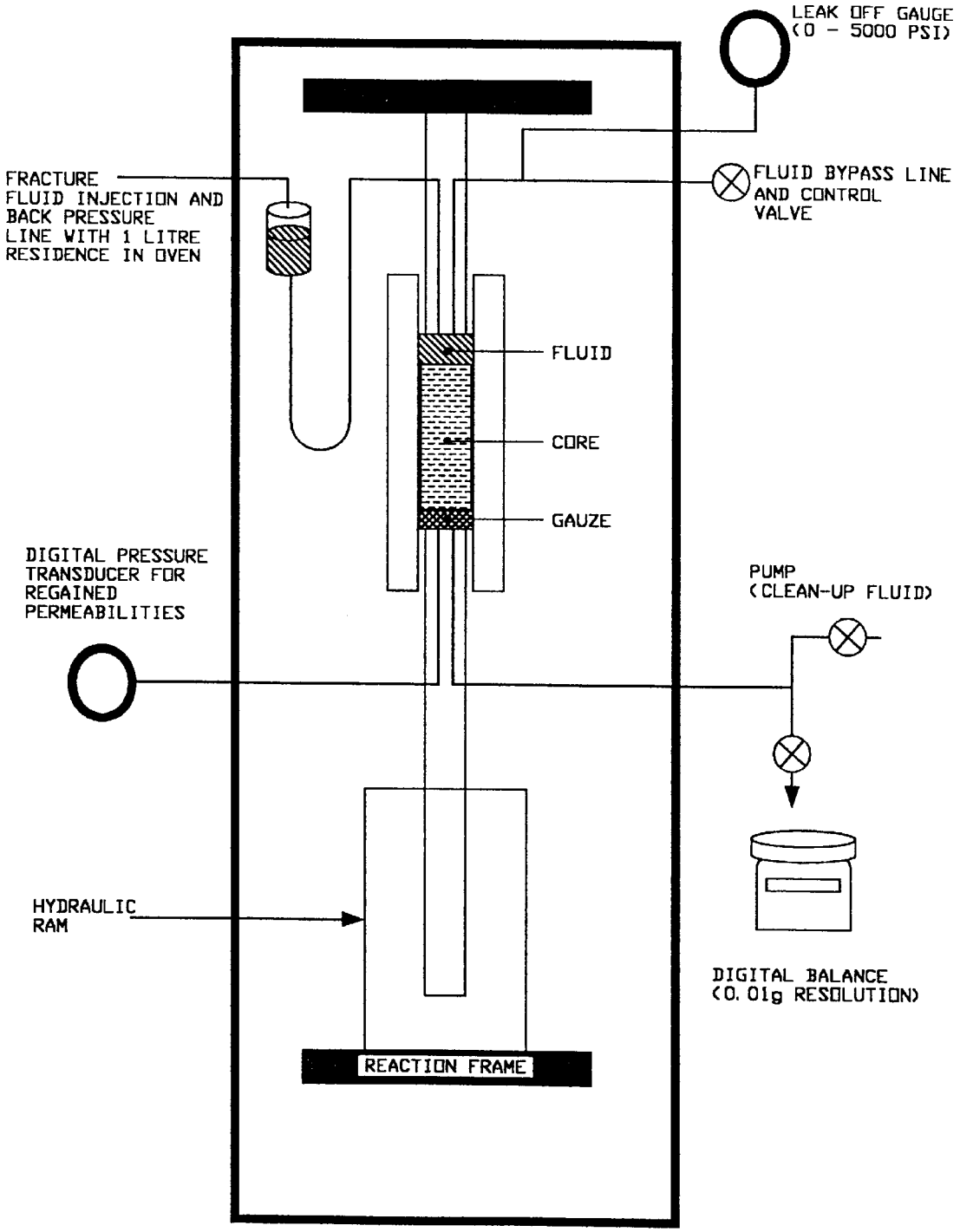
FIG. 11 is a sketch of the test apparatus used to demonstrate the properties of the fluid loss additive.

The core samples were brine saturated in a 2% KCl solution and placed in the test jig shown in FIG. 11. For simplicity, only one core holder is shown; however, the comparison tests were run concurrently. The fracturing fluid was then prepared:

2% KCl: pH8

Guar: 30 lb/1000 gallons (lb/tg)

Biocide: 0.1 gm/1000 gallons (g/tg)

Reduce pH to 5.0–5.5 (for hydration)

Hydrate stirred for 30 minutes

Increase pH to 8–8.5

The fluid was then split and the different fluid loss inhibitor additives added to each sample. Starch at 25 lb/tg was used in one core and the instant invention at 25 lb/tg was used in the second core. Static leak off was run for 60 minutes at 2000 psi, 150 degrees Fahrenheit. The fluid then flowed through the bypass line, the system pressurized, and the leak off valve opened. A gas accumulator, pre-charged to 2000 psi kept the system pressure at 2000 psi during initial leak off.

After 60 minutes, the leak off valve was shut and the pressure reduced to 100 psi. The test system(s) was (were) shut in for 12 hours.

After shut in, the filtrate, followed immediately by a pH7 2% KCl solution was pumped in reverse flow through the core at 2 cc/minute for six hours. Following this procedure, which simulated standard wellbore operations, a 10 lb/tg ammonium persulphate solution was pumped, in the leak off direction, for two hours. Reverse flow permeabilities in brine were then determined. Breakers are routinely used as part of the fracturing fluid.

The results of these tests is summarized in FIGS. 12A and 12B. Essentially an initial 18% clean-up was achieved for the starch inhibitor with damage attributed to the guar solution. The subsequent ammonium persulphate breaker squeeze increased clean-up to 61.5% In the case of the instant invention an initial 27.4%% clean-up was achieved with damage attributed to the guar solution. The subsequent ammonium persulphate breaker squeeze increased clean-up to 80.7%. (A significant improvement.)

The tests (conducted in an independent testing facility) concluded that a substantial part of the core damage was due to the guar polymer solution. The core damage was not due to polymer damage, but rather due to rather poor displacement of the linear guar solution (viscosity~10 cps). Thus, with viscous fingering, a substantial portion of the core matrix network was shut off from flow. This shut off was confirmed by the breaker squeeze off using ammonium persulphate. Further, the clean-up enabled the improvement of the instant invention over the usual starch product to be clearly seen.

It is believed that the best and preferred embodiments of the instant invention have been described in the forgoing. While particular embodiments of the present invention have been described, it is apparent that changes and modifications may be made without departing from the instant invention in its broader aspects; therefore, the aim of the claims is to cover such changes and modifications as fall within the true spirit and scope of the invention.

We claim:

1. A method for manufacturing a biodegradable fluid loss additive for well treating fluids comprising:

a) grinding biodegradable ball sealers having a composition of matter composed of collagen, glycerol, oxyzolidine, oil and water to form a biodegradable powder;

b) checking the particle distribution of the powder; and, c) repeating steps (a) and (b) until the required particle distribution is attained.

2. The method of claim 1 wherein said biodegradable ball seals further include methylsalicylate in said composition of matter.

3. The fluid loss additive of claim 1 wherein the particle distribution range is −80 mesh to +270 mesh.

4. The fluid loss additive of claim 2 wherein the particle distribution range is −80 mesh to +270 mesh.

5. A fluid loss additive for well treating fluids comprising a mixture of divided biodegradable particles formed by mixing a composition of matter composed of collagen, glycerol, oxyzolidine, oil, methylsalicylate and water within a temperature range falling between 56 degrees Fahrenheit and 160 degrees Fahrenheit, drying said mixture at a temperature between 100 degrees Fahrenheit and 220 degrees Fahrenheit, and grinding said mixture to form a powder wherein the particle distribution range of the powder is −80 mesh to +270 mesh.

6. A fluid loss additive for well treating fluids comprising a mixture of divided biodegradable particles formed by mixing a composition of matter composed of collagen, glycerol, oxyzolidine, oil, methylsalicylate and water within a temperature range falling between 140 degrees Fahrenheit and 160 degrees Fahrenheit, drying said mixture at a temperature between 140 degrees Fahrenheit and 210 degrees Fahrenheit for at least one hour, and grinding said mixture to form a powder wherein the particle distribution range of the powder is −80 mesh to +270 mesh and wherein the ranges of said individual constituents of the composition are oxyzolidine, 0.2 percent, collagen, 95 percent, oil, 0.2 percent, glycerol, 4 percent, methylsalicylate, 0.3 percent, and water between 0.1 and 40 percent.

7. A method for using a biodegradable fluid loss additive comprising the steps of:

a) mixing at least 51 percent by weight of biodegradable fluid loss additive with other fluid loss additives to form a first mixture, b) adding the first mixture to a fluid in the ratio between 5 and 50 pounds per 1000 gallons of fluid to form a second fluid; and, c) injecting the second fluid into the wellbore.

8. The fluid loss additive of claim 6 wherein the oil is corn oil.

9. The fluid loss additive of claim 6 wherein the oil is selected from other vegetable oils.

10. The method of claim 7 wherein another fluid loss additive is starch.

* * * * *